US008508318B2

(12) United States Patent
Iwanami

(10) Patent No.: US 8,508,318 B2
(45) Date of Patent: Aug. 13, 2013

(54) TRANSMISSION LINE FILTER

(75) Inventor: Mizuki Iwanami, Tokyo (JP)

(73) Assignee: NEC Corporation, Tokyo (JP)

( * ) Notice: Subject to any disclaimer, the term of this patent is extended or adjusted under 35 U.S.C. 154(b) by 831 days.

(21) Appl. No.: 12/531,325

(22) PCT Filed: Jan. 15, 2008

(86) PCT No.: PCT/JP2008/050360
§ 371 (c)(1),
(2), (4) Date: Dec. 7, 2009

(87) PCT Pub. No.: WO2008/114519
PCT Pub. Date: Sep. 25, 2008

(65) Prior Publication Data

US 2010/0109807 A1 May 6, 2010

(30) Foreign Application Priority Data

Mar. 16, 2007 (JP) ..... 2007-069028

(51) Int. Cl.
*H01P 1/203* (2006.01)

(52) U.S. Cl.
USPC ..... 333/205

(58) Field of Classification Search
USPC ..... 333/161, 205, 202, 238
See application file for complete search history.

(56) References Cited

U.S. PATENT DOCUMENTS 6,057,747 A * 5/2000 Takenoshita et al. ..... 333/137
6,216,020 B1 * 4/2001 Findikoglu ..... 505/210
2002/0097117 A1 * 7/2002 Chiu et al. ..... 333/238
2003/0052750 A1 * 3/2003 Shamsaifar et al. ..... 333/202
2003/0227360 A1 * 12/2003 Kirihara et al. ..... 333/239

FOREIGN PATENT DOCUMENTS

| | | | |
|---|---|---|---|
| JP | 3-071598 | A | 3/1991 |
| JP | 3-108192 | A | 5/1991 |
| JP | 3-128501 | A | 5/1991 |
| JP | 7-74506 | A | 3/1995 |
| JP | 7-111407 | A | 4/1995 |
| JP | 8-078907 | A | 3/1996 |
| JP | 8-154006 | A | 6/1996 |
| JP | 9-232805 | A | 9/1997 |
| JP | 10-013105 | A | 1/1998 |
| JP | 10-039265 | A | 2/1998 |
| JP | 11-239002 | A | 8/1999 |
| JP | 11-284407 | A | 10/1999 |
| JP | 2001320202 | A | 11/2001 |
| JP | 2006060112 | A | 3/2006 |
| JP | 2006145726 | A | 6/2006 |

OTHER PUBLICATIONS

International Search Report for PCT/JP2008/050360 mailed Apr. 22, 2008.
Japanese Office Action for JP 2009-505089 mailed on May 27, 2013 with English Translation.

* cited by examiner

*Primary Examiner* — Benny Lee
*Assistant Examiner* — Gerald Stevens

(57) ABSTRACT

A stop band or a pass band is generated in a transmission line filter by providing a plurality of dielectric bodies having a periodic structure in the length direction of the transmission line filter and causing Bragg reflection of transmission wave. A voltage is applied to some or all of the dielectric bodies and the frequency of the stop band or the pass band is changed or controlled by adjusting the voltage.

15 Claims, 7 Drawing Sheets

TRANSMISSION LINE FILTER

TECHNICAL FIELD

The present invention relates to a transmission line filter and a transmission line filter control method, more particularly, to a transmission line filter having a pass band or a stop band and a transmission line filter control method of controlling the pass band or the stop band of the transmission line filter.

This application is the National Phase of PCT/JP2008/050360, filed Jan. 15, 2008, which claims priority from Japanese Patent Application No. 2007-069028, which is incorporated herein by reference.

BACKGROUND ART

Band pass filters and band stop filters are conventional passive elements for filtering microwave signals. Such elements are used to cut spurious wave and noise components in measurement instruments such as spectrum analyzers and amplifiers. Besides such elements are also utilized for improving the communication performance in a communication device such as a cellular phone.

In addition, in order to make a filtering frequency band variable, the filtering frequency is conventionally controlled with a combination of microwave transmission lines and semiconductor diodes by applying a voltage. Further, a method of using ferroelectric material for a transmission line base material to control the filtering frequency by applying a voltage to the ferroelectric material has been also reported.

Further, in order to selectively transmit only a signal of a certain frequency, a high performance microwave filter that generates a narrow pass band in a wide stop band is also devised.

Referring to the foregoing, Japanese Laid-Open Patent Application No. Heisei 03-108192 discloses an invention directed to a ferroelectric memory.

The ferroelectric memory of Japanese Laid-Open Patent Application No. Heisei 03-108192 is provided with a lower electrode, an upper electrode, a ferroelectric layer, and an antiferroelectric layer. The lower electrode is formed in the stripe shape. The upper electrode is arranged so as to be perpendicular to the lower electrode, and is also formed in the stripe shape. The ferroelectric layer is arranged between the lower electrode and the upper electrode, and changes the polarization state by the electric field applied between the both electrodes. The antiferroelectric layer is arranged between the lower electrode and the ferroelectric layer and/or between the upper electrode and the ferroelectric layer.

In addition, Japanese Laid-Open Utility Model Application No. Heisei 03-71598 discloses an invention directed to an electroluminescence light.

The electroluminescence light disclosed in Japanese Laid-Open Utility Model Application No. Heisei 03-71598 has an insulating layer and a light-emitting layer interleaved between a transparent electrode and a back electrode. Barium titaniate zirconate is employed for the insulating layer formed by dispersing high dielectric material powders in a binder.

Further, Japanese Laid-Open Patent Application No. Heisei 07-111407 discloses an invention directed to a ferroelectric transmission line.

The ferroelectric transmission line of Japanese Laid-Open Patent Application No. Heisei 07-111407 is provided with ferroelectric material on a ground conductor, the ferroelectric material having a variable dielectric constant which depends on the magnitude of an applied electric field. In addition, a transmission line through which microwave is propagated is formed by a conductor pattern on the ferroelectric material. By varying the dielectric constant of the ferroelectric material with a voltage applied to the conductor pattern, characteristics of the microwave are changed.

In addition, Japanese Laid-Open Patent Application No. Heisei 10-39265 discloses an invention directed to an electro-optic element.

The electro-optical element of Japanese Laid-Open Patent Application No. Heisei 10-39265 is provided with a ferroelectric substrate and polarization inversion domains formed within the ferroelectric substrate in a predetermined shape. At least one of the domain walls of the polarization inversion domains is perpendicular or approximately perpendicular to the main surface of the ferroelectric substrate. A light beam is formed so that the light beam passes at least two domain walls, and electrodes are disposed on the side surfaces of the ferroelectric substrate along the propagation direction of the light beam, which side surfaces are different from the main surface.

Further, Japanese Laid-Open Patent Application No. Heisei 11-239002 discloses an invention directed to a phase shifter. The phase shifter of Japanese Laid-Open Patent Application No. Heisei 11-239002 is capable of controlling a phase delay quantity in delaying the phase of the electromagnetic wave of 1 THz or less. This phase shifter is provided with a pair of transmission lines and dielectric material. In this case, the paired transmission lines, which are disposed so as to be opposed with each other, transmit the electromagnetic wave, and a control voltage of a frequency lower than that of the electromagnetic wave is applied between one transmission line and other transmission line for controlling the shift delay quantity. The dielectric material is provided between the paired transmission lines, and the dielectric constant thereof is varied in accordance with the control voltage. In addition, Japanese Laid-Open Patent Application No. 2006-60112 discloses an invention directed to a print circuit.

The print circuit of Japanese Laid-Open Patent Application No. 2006-60112 is provided with a transmission line having dielectric material body including ferroelectric material between a signal line and a ground or a power source line.

In addition, Japanese Laid-Open Patent Application No. 2006-145726 discloses an invention directed to an electromagnetic wave direction control element.

The electromagnetic wave direction control element of Japanese Laid-Open Patent Application No. 2006-145726 is formed with photonic crystal dielectric compound substance, high-dielectric constant dielectric substance, and low-dielectric constant dielectric substance. Here, the photonic crystal dielectric compound substance has a periodic structure such that second dielectric substance having a second dielectric constant is periodically arrayed in first dielectric substance having a first dielectric constant, of which second dielectric constant is different from the first dielectric constant. The high-dielectric constant dielectric substance has no periodic structure but has a third dielectric constant. The low-dielectric constant dielectric substance has no periodic structure but has a forth dielectric constant lower than the third dielectric constant. In addition, an input side photonic crystal portion, an input side crystal defect portion, an intermediate photonic crystal portion, an output side crystal defect portion, and an output side photonic crystal portion are sequentially arranged from an input end side of the electromagnetic wave toward an output end side of the electromagnetic wave. Here, the input side photonic crystal portion includes a photonic crystal dielectric compound substance. The input side crystal defect portion includes the high-dielectric constant dielectric substance. The intermediate photonic crystal portion includes a photonic crystal dielectric compound substance. The output side crystal defect portion includes the low-dielectric constant dielectric substance. The output side photonic crystal portion includes a photonic crystal dielectric compound substance.

DISCLOSURE OF INVENTION

An object of the present invention is to provide a transmission line filter which generates an unconventionally wide stop band and is also capable of controlling the stop band.

Another object of the present invention is to provide a transmission line filter generates a narrow pass band in a wide stop band and is also capable of controlling the pass band.

A transmission line filter according to the present invention is provided with a plurality of ferroelectric bodies of the same shape arranged periodically in one direction; and a strip conductor connecting the ferroelectric bodies in the periodical arrangement direction.

A control method of a transmission line filter according to the present invention includes: (a) a step of inputting arbitrary transmission wave into a transmission line filter; (b) a step of causing Bragg reflection on said transmission wave by using a plurality of dielectric bodies having a periodic structure in the length direction of said transmission line filter; (c) a step of changing a frequency of a stop band caused by said Bragg reflection by applying a predetermined voltage to at least one of said plurality of dielectric bodies in a direction perpendicular to the length direction of said transmission line filter; and (d) a step of controlling the frequency of said stop band by controlling said applied voltage.

BEST MODE FOR CARRYING OUT THE INVENTION

Hereinafter, best modes for carrying out the transmission line filter according to the present invention will be described referring to the attached drawings.

First Embodiment

Figure 1:
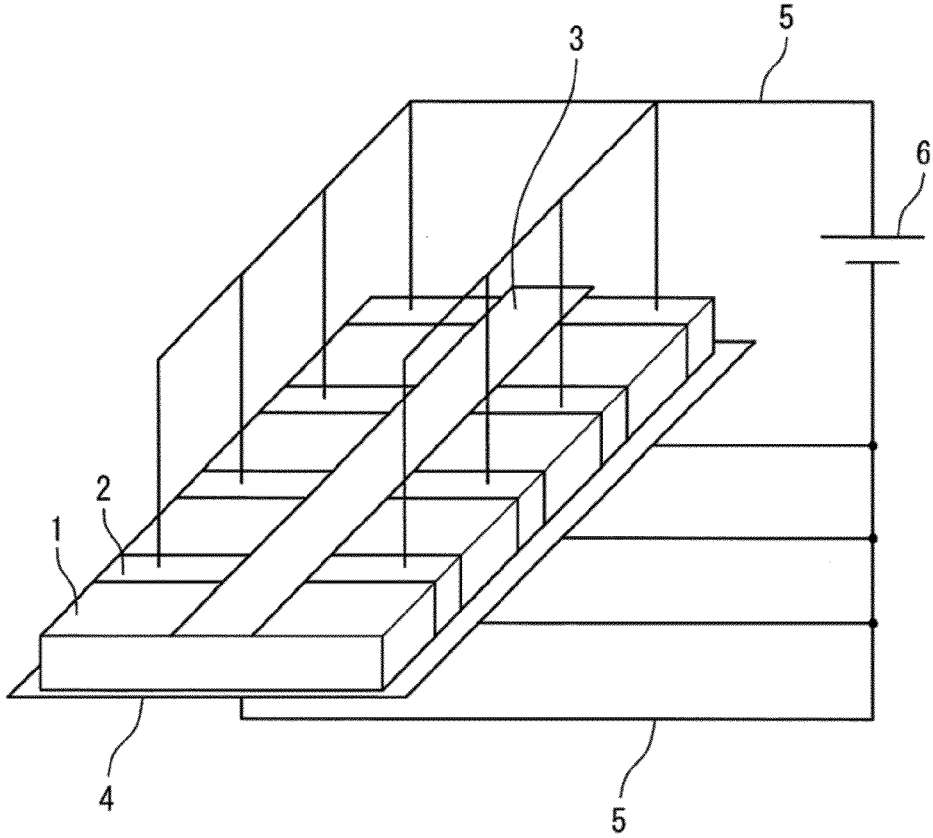
FIG. 1 is a perspective view of a transmission line filter in a first embodiment of the present invention.

FIG. 1 is a perspective view of a transmission line filter in a first embodiment of the present invention.

The transmission line filter in this embodiment is provided with a strip conductor 3, a ground plane 4, a plurality of paraelectric bodies 1, and a plurality of ferroelectric bodies 2. The paraelectric bodies 1 have the same size, and the ferroelectric bodies 2 also have the same size.

The transmission line filter of this embodiment has a three-layered structure. An intermediate layer incorporating the paraelectric bodies 1 and the ferroelectric bodies 2 is placed between a layer of the strip conductor 3 and a layer of the ground plane 4. In this intermediate layer, the paraelectric bodies 1 and ferroelectric bodies 2 are arrayed alternately and periodically in the traveling direction of the electromagnetic wave.

A voltage source 6 is connected to each of the ferroelectric bodies 2 through lead wires 5. The lead wires 5 are connected to each of the ferroelectric bodies 2 so that the voltage of the voltage source 6 is applied to the direction perpendicular to the traveling direction of the electromagnetic wave. Specifically, the lead wires 5 are each connected at one end to the face on which the plurality of ferroelectric bodies 2 is brought into contact with the strip conductor 3, and the lead wires 5 are connected at the other end to a face where the plurality of ferroelectric bodies 2 is brought into contact with the ground plane 4. Here, the ground plane 4 has holes (not illustrated) directly below the ferroelectric bodies 2 so that the lead wires 5 can be connected to the ferroelectric bodies 2. However, the holes are not necessarily formed through the ground plane 4. In this case, the lead wires 5 are connected to the faces of the ferroelectric bodies 2 opposite to the ground plane 4 and to the ground plane 4. In this case, the direction of the voltage to be applied to the ferroelectric bodies 2 is directed in the direction perpendicular to the face of the ground plane, and therefore this direction is directed to the direction vertical to the traveling direction of the electromagnetic wave.

The transmission characteristics of the transmission line filter of this embodiment has a broad stop band, on the basis of Bragg reflection of wave as a basic principal. The connection of the transmission line filter to the voltage source as shown in FIG. 1 allows applying an electric field in the thickness direction of the ferroelectric bodies to thereby change the components of the thickness direction of the tensor dielectric constant of the ferroelectrics bodies. The direction of the electric field of the transmitted microwave in the ferroelectric bodies is mainly the thickness direction of the ferroelectric bodies, so that the wavelength of the transmission wave is changed upon the change of the relative dielectric constant. As a result, the frequencies of the broad stop band are shifted. The frequencies of the stop band can be controlled by adjusting the volume of the applied voltage.

Second Embodiment

Figure 2:
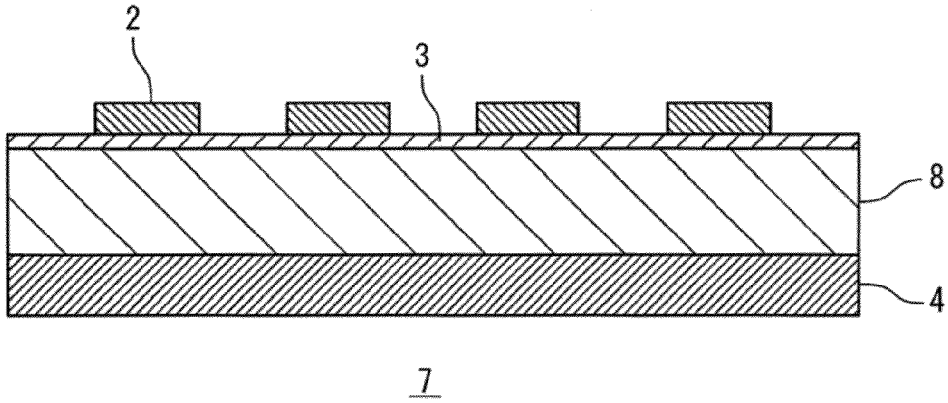
FIG. 2 is a sectional view in the length direction of a micro strip line in a transmission line filter in a second embodiment of the present invention.
Figure 3:
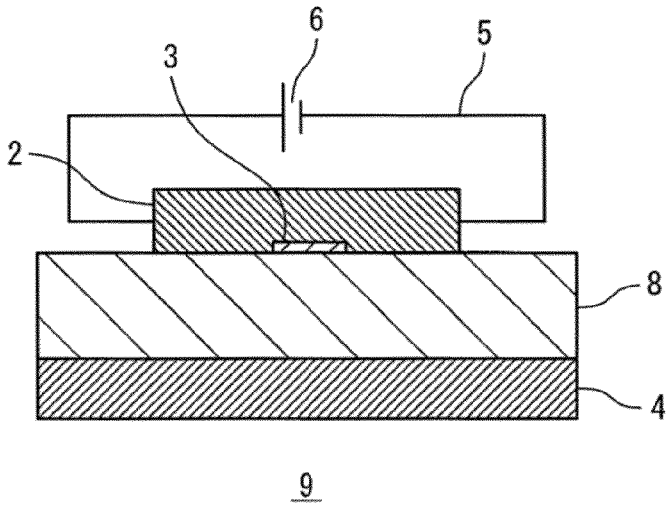
FIG. 3 is a sectional view that is vertical to the transmitted wave travel direction of a micro strip line in the transmission line filter in the second embodiment of the present invention.

FIG. 2 is a sectional view in the length direction of a micro strip line in a transmission line filter in a second embodiment of the present invention. FIG. 3 is a sectional view vertical to the transmission wave travel direction of the micro strip line in the transmission line filter in the second embodiment of the present invention.

The transmission line filter of this embodiment is provided with a plurality of ferroelectric bodies 2, a strip conductor 3, a ground plane 4, and a dielectric layer 8. The ferroelectric bodies 2 have the same size.

The transmission line filter in this embodiment has a four-layered structure. The lowest layer is the ground plane 4. The dielectric layer 8 is located on the ground plane 4. Placed on the dielectric layer 3 is the strip conductor 3, and the width thereof is very narrower than the width of the ground plane 4 or the width of the dielectric layer 8. On the top of this structure, the ferroelectric bodies 2 are periodically arranged in the length direction of the strip conductor 3. In this case, the ferroelectric bodies 2 are each placed on the dielectric layer 8 so as to surround the strip conductor 3. It should be noted, however, that the ferroelectric bodies 2 are separated from each other, so that the strip conductor 3 is exposed between two adjacent ferroelectric bodies 2.

By periodically arraying the plurality of ferroelectric bodies 2 as shown in FIG. 2, the transmission characteristics of the present transmission line filter has a broad stop band because of the same reason as the above. By connecting the ferroelectric bodies 2 to the voltage source as shown in FIG. 3, an electric field is applied to the width direction of the strip conductor to thereby change the component in the width direction of the tensor dielectric constant of the ferroelectric. The direction of the electric field of the transmission microwave in the ferroelectric is mainly the width direction of the strip conductor, so that the wavelength of the transmission wave is changed upon the change of the relative dielectric constant. As a result, the frequency of the broad stop band is shifted. The frequency of the stop band can be controlled by adjusting the magnitude of the applied voltage.

Third Embodiment

Figure 4:
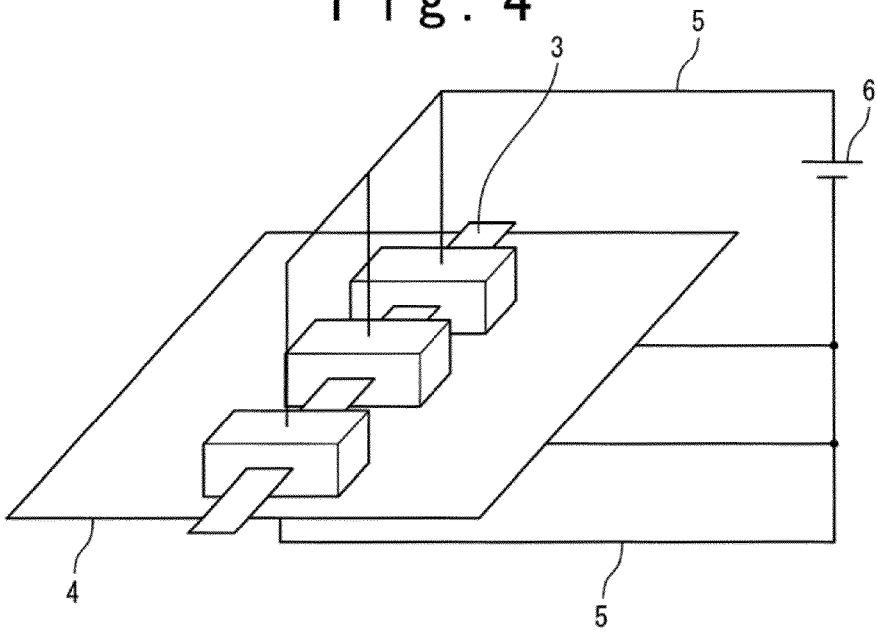
FIG. 4 is a perspective view of a transmission line filter in a third embodiment of the present invention.

FIG. 4 is a perspective view of a transmission line filter in a third embodiment of the present invention. The transmission line filter of this embodiment is provided with a plurality of ferroelectric bodies 2, a strip conductor 3, and a ground plane 4. The ferroelectric bodies 2 have the same size, each having a hole, the size of which is just enough for the strip conductor 3 to pass through the hole.

In the transmission line filter of this embodiment, the strip conductor 3 penetrates through each of the ferroelectric bodies 2, which is periodically arrayed on the ground plane 4. Lead wires 5 are connected to the ferroelectric bodies 2, respectively, so that a voltage of the voltage source 6 is applied to the direction perpendicular to the face of the ground plane 4. Therefore, holes (not illustrated) for allowing the lead wires 5 to pass therethrough are formed below the ferroelectric bodies 2 through the ground plane 4.

Also when the dielectric layer of the transmission line filter is structured as shown in FIG. 4, the transmission characteristics exhibits a broad stop band. By connecting the transmission line to the voltage source as shown in FIG. 4, an electric field is applied to the thickness direction of the ferroelectric bodies to thereby change the components in the thickness direction of the tensor dielectric constant of the ferroelectric bodies. The direction of the electric field of the transmission microwave in the ferroelectric bodies is mainly the thickness directions of the ferroelectric bodies, so that the wavelength of the transmission wave is changed upon the change of the relative dielectric constant. As a result, the frequency of the broad stop band is shifted. The frequency of the stop band can be controlled by adjusting the volume of the applied voltage.

Fourth Embodiment

Figure 5:
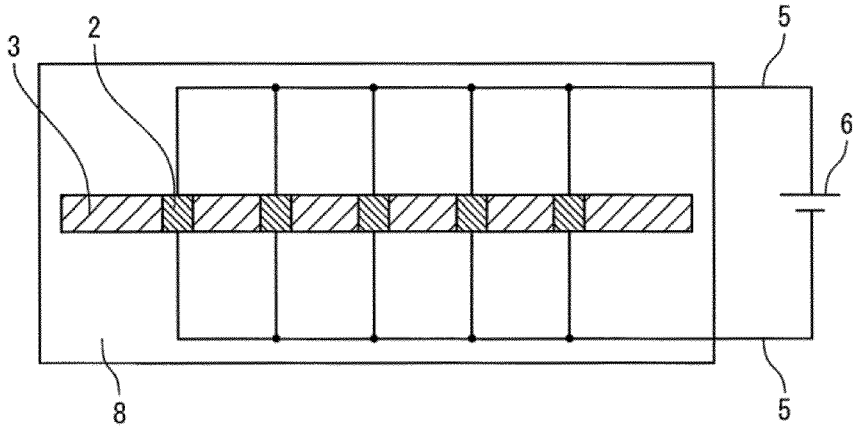
FIG. 5 is a top plan view of a transmission line filter in a forth embodiment of the present invention.

FIG. 5 is a top plan view of a transmission line filter in a forth embodiment of the present invention.

The transmission line filter of this embodiment is provided with a plurality of ferroelectric bodies 2, a plurality of strip conductors 3, and a dielectric layer 8. The ferroelectric bodies 2 have the same size. In addition, at least some of the strip conductors 3 also have the same size. Further, the width of the ferroelectric bodies 2 is equal to the width of the strip conductors 3.

In the transmission line filter of this embodiment, the ferroelectric bodies 2 and strip conductors 3 are alternately and periodically connected and mounted on the dielectric layer 8. In other words, the transmission line filter is constructed in such a manner that a strip conductor 3 is periodically divided and the ferroelectric bodies 2 are each putted between the divided segments in place of the conductors. Further, it is necessary for the strip conductors 3 arranged between two ferroelectric bodies 2 to have the same size due to the periodicity thereof; however, this does not apply to the sizes of the strip conductors 3 at the both ends.

Lead wires 5 are connected to the ferroelectric bodies 2 so that the voltage of the voltage source 6 is applied to each of the ferroelectric bodies 2 in the same direction. This application direction is parallel to the face of the dielectric layer 8 and is perpendicular to the connecting direction between the ferroelectric bodies 2 and the strip conductors 3.

The ferroelectric bodies 2 are structured so that, when an electric filed is applied, the dielectric constant components in the direction vertical to the direction of the applied electric field are largely changed. Due to the division of the strip conductors 3, capacitances are generated between the conductors 3 and the positions where the capacitances are generated are periodic and the volumes thereof are equal. Therefore, because of the same reason as the above, the transmission characteristics of the present transmission line have a broad stop band. By connecting the ferroelectric bodies 2 to the voltage source 6 as shown in FIG. 5, an electric field is applied in the width direction of the strip conductors 3, and the relative dielectric constant in the direction perpendicular to the direction of the applied electric field, namely, the relative dielectric constant in the length direction of the conductor is largely changed. As a result, the capacitance between the conductors 3 is changed, and the wavelength of the transmission wave is changed upon this change. Then, the frequency of the broad stop band is shifted. The frequency of the stop band can be controlled by adjusting the magnitude of the applied voltage.

Fifth Embodiment

A fifth embodiment of the present invention is represented by any transmission line shown from FIGS. 1 to 5, and in this embodiment, one or some of the periodically arrayed ferroelectric bodies, for example, only the ferroelectric body located on a certain point is connected to the voltage source. In this case, the relative dielectric constant of the ferroelectric body connected to the voltage source can be selectively changed. According to the transmission characteristics of the present embodiment, a narrow pass band is generated in a wide stop band, when the relative dielectric constant of the ferroelectric is changed. This phenomenon is the same as the phenomenon such that a defect (impurity) level is generated in the forbidden band of the energy band structure when defects are introduced in a perfect crystal. Further, the frequency of the pass band in the stop band can be changed by varying the magnitude of the voltage applied to the ferroelectric body. In other words, the amount of the change in the frequency of the pass band can be controlled by adjusting the magnitude of the voltage applied to the ferroelectric body.

Figure 6:
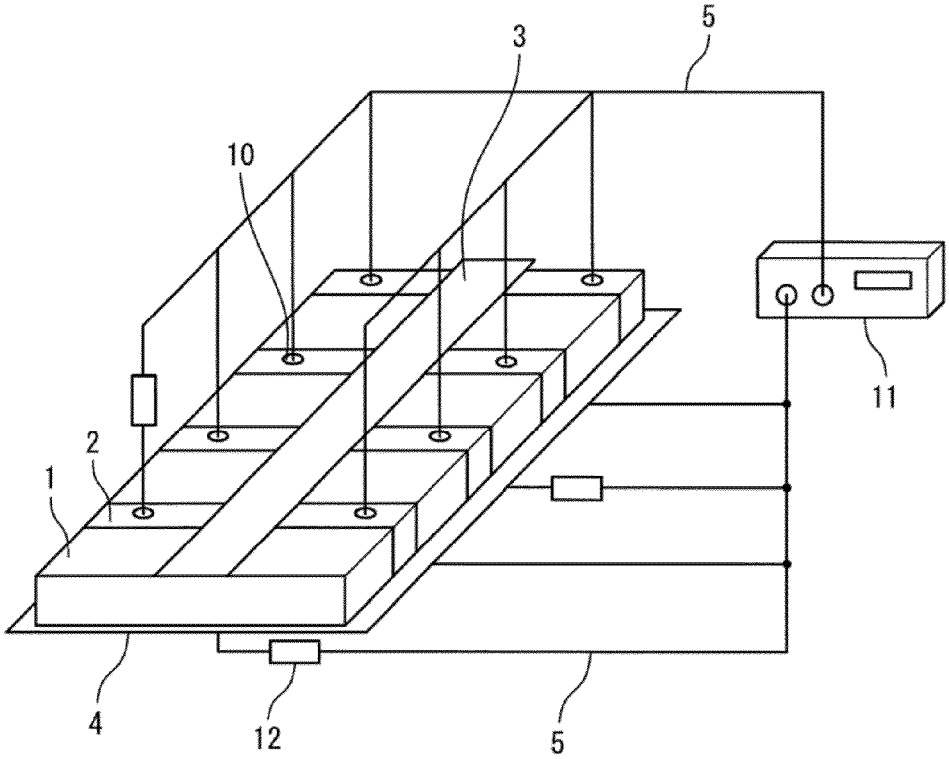
FIG. 6 shows a transmission line filter and a voltage generator that is connected to the transmission line filter, in one example of the present invention.

FIG. 6 illustrates a first example based on the first embodiment. At first, a micro strip line having a dielectric layer having two kinds of dielectric bodies 1 and 2 periodically arrayed in a travel direction of a transmission wave is manufactured. For example, an aerosol deposition method, which is a new ceramic film manufacturing method, is employed upon manufacture of the micro strip line. The use of the aerosol deposition method allows forming a ceramics film with a thickness in a range of several microns to several tens microns on an arbitrary substrate at the room temperature. For example, alumina films and barium titanate films are alternately and periodically arrayed on a tabular copper substrate of 4 cm square by using a mask for film patterning, as shown in FIG. 5. The width and thickness in the length direction of the strip conductor are defined as 2 mm and about 10 micron, respectively, for example. When the number of the alumina films and the barium titanate films, which are repeatedly arrayed in the length direction of the conductor, is ten, while the entire length of the line is 4 cm, which is the same as the size of the substrate. By using a thin film forming apparatus such as a spattering apparatus and a mask after forming the dielectric layer, a 4 cm-length and 1 mm-width strip conductor is formed, for example. After forming the line, silver paste 10 is applied onto the ferroelectric bodies 2 as shown in FIG. 6, and the line is connected to a voltage generator 11 via the lead wires 5. Further, holes are mechanically formed through the substrate 4 and the bottoms of the ferroelectric bodies are connected to the voltage generator through the lead wires 5 with the silver paste 10 also applied onto the bottom of the ferroelectric bodies. In addition, a micro ferrite core 12 is fitted to the lead wires 5 so as to prevent the transmission microwave from leaking to the voltage generator.

Figure 8:
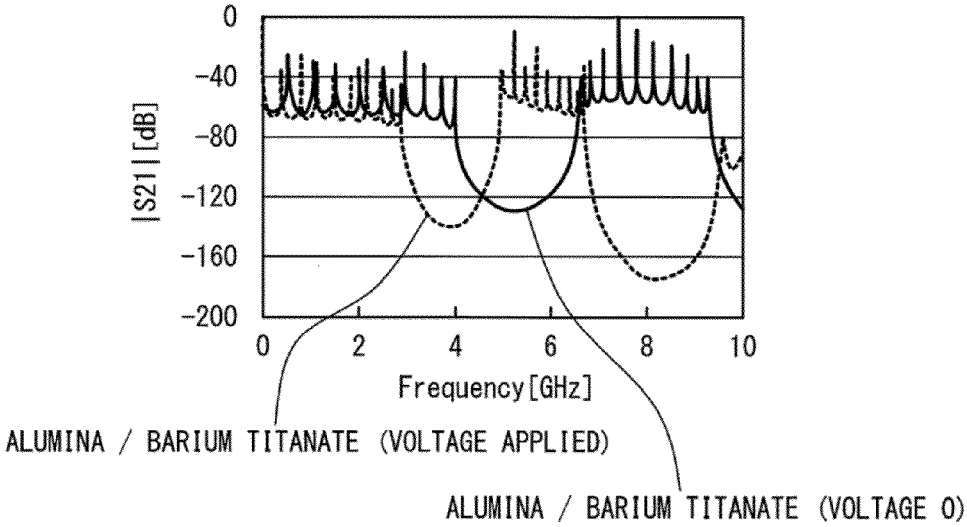
FIG. 8 shows the transmission characteristics of a transmission line filter according to the present invention.

FIG. 8 shows the transmission characteristics of the above-described transmission line filter shown in in FIG. 6. FIG. 8 illustrates the comparison result between a case that a voltage is applied to barium titanate, which is ferroelectric material, and a case that no voltage is applied thereto. The relative dielectric constant of alumina is 9, and relative dielectric constant of barium titanate is 200 for the case when a voltage is applied thereto, and 100 for the case when no voltage is applied thereto. The width of the stop band, in which the transmission amount of electromagnetic wave is very small, is in the order of GHz, and the application of a voltage allows largely shifting the band. The frequency of the stop band can be changed by varying the magnitude of the applied voltage. In other words, the adjustment of the applied voltage allows controlling the frequency of the stop band.

Further, the ferroelectric bodies are not limited to barium titanate; lead ziroconate titanate or lead lead ziroconate titanate doped with lanthanum may be used instead, for example.

Figure 7A:
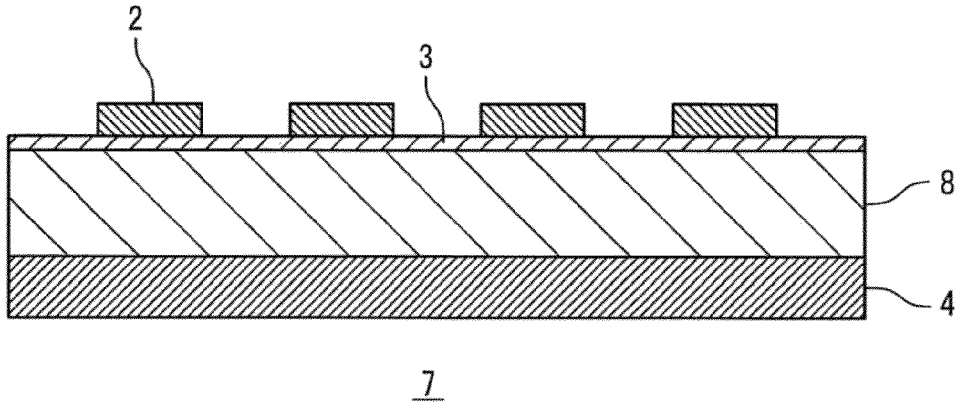
FIG. 7A is a sectional view in the length direction of a micro strip line in a transmission line filter in one example of the present invention.
Figure 7B:
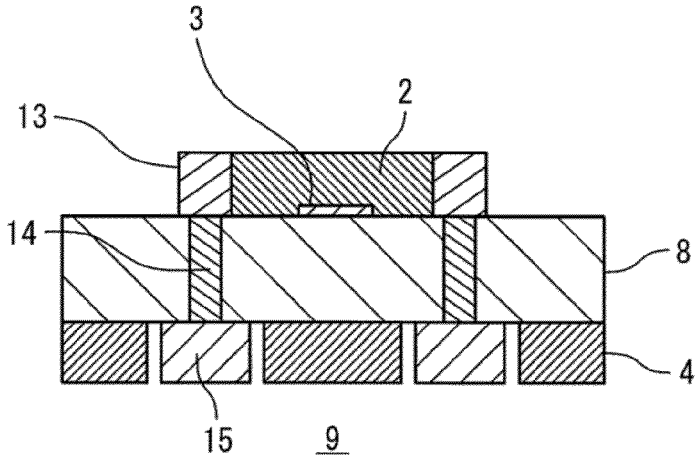
FIG. 7B is a sectional view that is vertical to the transmitted wave travel direction of the micro strip line in the transmission line filter in this example of the present invention.

FIGS. 7A and 7B show a second example according to the present invention, which relates to the above-described second embodiment. FIG. 7A is a sectional view in the length direction of the micro strip line in the transmission line filter in this example. FIG. 7B is a sectional view vertical to the transmitted wave travel direction of the micro strip line in the transmission line filter in this example. In FIGS. 7A and 7B, electrodes 13 are formed on the opposite ends of the ferroelectric bodies 2, and the electrodes 13 are connected to vias 14 that pass through the dielectric layer 8; further, the via holes 14 are connected to pads 15 located in the ground layer 4. The ferroelectric bodies 2 may be formed by the above-described aerosol deposition method, for example, and the electrodes 13 may be formed by using a mask by means of a thin film forming method such as a spattering method. The ferroelectric bodies 2 are connected to a voltage generator via the vias 14, the pads 15, and lead wires connected to the pads, and a voltage is applied to the ferroelectric bodies to shift the frequency of the above-mentioned broad stop band. The frequency of the stop band can be controlled by adjusting the magnitude of the applied voltage.

In a third example of the present invention, a voltage is applied only to a center ferroelectric in the transmission line of the first example. In other words, manufacturing a micro strip line in accordance with the content of the first example, for example, and after manufacture of the micro strip line, applying a silver paste only to the center ferroelectric, the ferroelectric is connected to a voltage generator via a lead wire. Further, mechanically forming a hole on a copper substrate and applying the silver paste also on the bottom of the center ferroelectric, the bottom of the center ferroelectric and the voltage generator are connected to each other via the lead wire. In addition, a micro ferrite core is fitted to the lead wire so as to prevent a transmission microwave from leaking to a side of the voltage generator.

Figure 9:
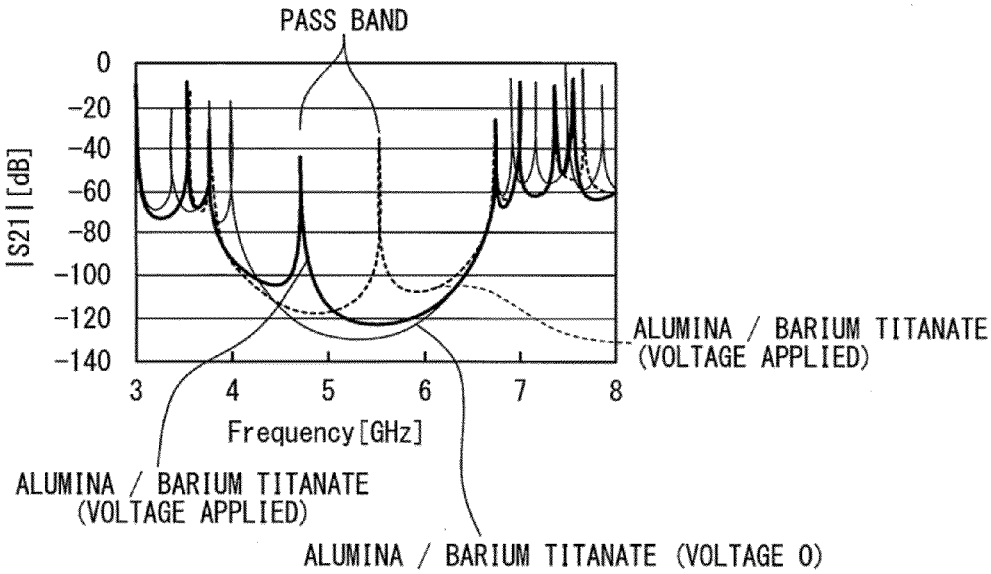
FIG. 9 shows the transmission characteristic of a transmission line filter according to the present invention.

FIG. 9 shows a transmission characteristic of the above-described transmission line filter, and this illustrates a comparison result between a case where a voltage is applied only to center barium titanate and a case where a voltage is not applied thereto. The level of the voltage is set to two different values. The relative dielectric constant of alumina is 9. The relative dielectric constant of barium titanate is 40 (represented by a bold solid line) or 20 when a voltage is applied thereto (represented by a broken line), and the relative dielectric constant of barium titanate is 100 (represented by a narrow solid line) when no voltage is applied thereto. The application of the voltage results in that a narrow pass band is generated in the bold stop band, and the frequency of the pass band is differed depending on the voltage value. In other words, the frequency of the pass band can be controlled by adjusting the magnitude of the voltage applied to the ferroelectric body.

Although the ferroelectric body located at the center of the transmission line is selected as the place where the voltage is applied, the place where the voltage is applied is not limited to the same. In addition, the voltage may be applied not only to one place but also some ferroelectric bodies.

As previously described, in the transmission line filter according to the present invention, the dielectric layer is constructed in such a manner that different kinds of dielectric bodies are alternately and periodically arrayed in the travel direction of the electromagnetic wave. At the same time, any one of the different kinds of dielectric bodies is formed with ferroelectric, the stop band is changed by applying a voltage to the ferroelectric bodies.

In addition, in the line transmission filter, ferroelectric bodies are inserted between portions of the strip conductor and periodically placed in the length direction of the conductor; the frequency of the stop band can be changed by applying a voltage to the ferroelectric bodies.

The electromagnetic transmission characteristics of a transmission line, in which a dielectric layer is formed by two different kinds of dielectric bodies and these dielectric bodies are alternately and periodically arrayed in the travel direction of electromagnetic wave, has a broad stop band having a band width of 1 GHz or more due to the same effect as the Bragg reflection in the crystal, because of the periodical changes in the relative dielectric constant of the dielectric layer.

Also, a transmission line in which ferroelectric bodies are inserted in portions of the strip conductor and these ferroelectric bodies are periodically placed in the length direction of the conductor exhibits periodical changes in the the relative dielectric constant of the strip conductor portions; as a result, the transmission characteristics of this transmission line also has a broad stop band having a band width of 1 GHz or more.

Figure 10:
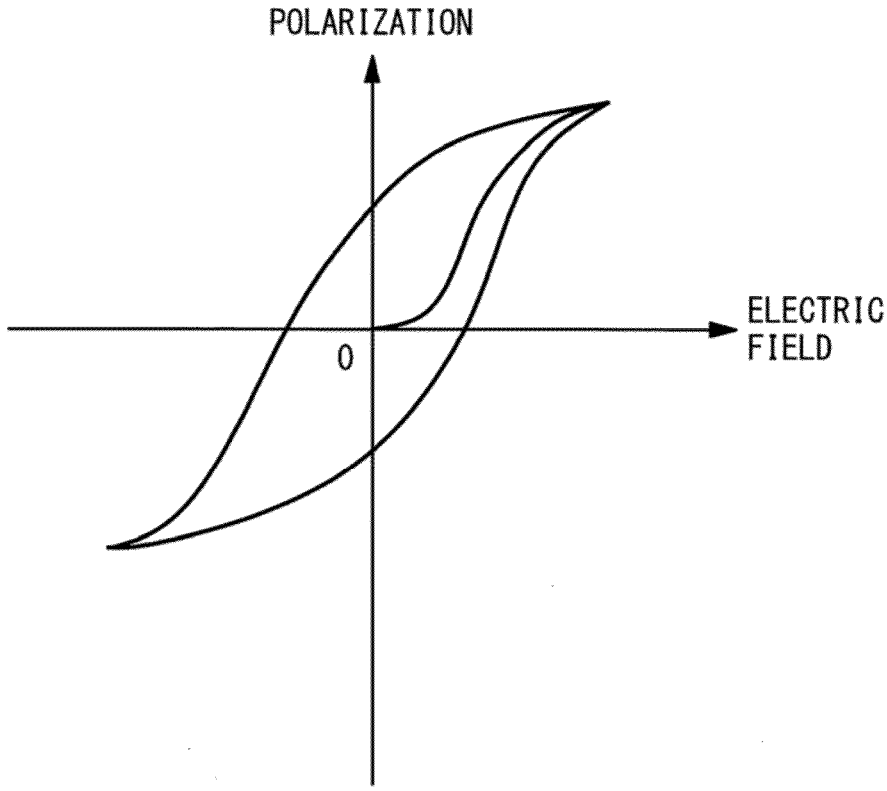
FIG. 10 is a pattern diagram showing the polarization-electric field characteristics of general ferroelectric material.

On the other hand, the polarization-electric field characteristics of ferroelectric material generally has nonlinear characteristics accompanied with hysteresis as shown in FIG. 10, and the present invention relates to a transmission line which allows changing the filter characteristics by changing the relative dielectric constant of the ferroelectric bodies by using such nonlinear polarization-electric field characteristics. Assuming that the relative dielectric constant of the ferroelectric has no aeolotropy, the relative dielectric constant can be represented as follows:

$$\in r = P/(\in 0 \cdot E) + 1 \quad \text{(Equation 1)}$$

($\in$r: relative dielectric constant, P: polarization vector, $\in$0: vacuum dielectric constant, E: electric field vector)

Accordingly, when the polarization P is linear with respect to the electric field E, namely, P=aE (a: constant), the relative dielectric constant is not changed due to the electric field; for the ferroelectric material, however, the relative dielectric constant of the ferroelectric material has an aeolotropy (represented by a tensor), and the polarization is nonlinear with respect to the electric field as shown in FIG. 10. Therefore, the relative dielectric constant of the ferroelectric is changed in accordance with the electric field.

Accordingly, by applying an electric field to the ferroelectric bodies in the above-described transmission line filter, which can generate a broad stop band, the relative dielectric constant of the ferroelectric bodies is changed. As a result, the wavelength fractional shortening of the electromagnetic wave that transmits the ferroelectric bodies is changed, and the frequency of the stop band is shifted. In other word, the stop band can be changed by applying a voltage to the ferroelectric bodies that are periodically arrayed; further, the amount of the change in the frequency of the stop band can be controlled by adjusting the magnitude of the voltage.

In addition, application of a voltage to one or some of the ferroelectric bodies that are periodically arrayed in the above-described transmission line, for example, a ferroelectric body at a certain point, allows providing a ferroelectric body having a different relative dielectric constant only on that point. In such a case, the transmission characteristics are obtained in which a narrow pass band is generated in a broad stop band. In other words, a filter is realized which enables only a signal with a desired frequency in the stop band to propagate therethrough. This phenomenon is the same as the phenomenon such that a defect (impurity) level is generated in the forbidden band of the energy band structure in the case where defects are introduced in a perfect crystal as a basic principal.

Further, the frequency of the pass band in the stop band can be controlled by varying the magnitude of the voltage applied to the ferroelectric bodies. In other words, the amount of change in the frequency of the pass band can be controlled by adjusting the magnitude of the voltage applied to the ferroelectric bodies.

The present invention allows providing a transmission line filter which can generate a unconventionally broad stop band and control this broad stop band; this transmission line filter can be used as a new passive element for a microwave circuit.

In addition, the present invention allows providing a transmission line filter which can generate a narrow pass band in a broad stop band, and control the pass band; this transmission line filter can be used as an unconventionally flexible filter so as to improve the performance of a microwave circuit.

What is claimed is:

1. A transmission line filter comprising:

a plurality of ferroelectric bodies of the same shape arranged periodically in a periodical arrangement direction;

a strip conductor connecting said plurality of ferroelectric bodies in said periodical arrangement direction;

a plurality of paraelectric bodies having a dielectric constant lower than that of said plurality of ferroelectric bodies;

a ground plane, wherein said plurality of paraelectric bodies are of the same shape and arranged in a same direction as said periodical arrangement direction of said plurality of ferroelectric bodies, wherein a dielectric composite layer including said plurality of ferroelectric bodies and said plurality of paraelectric bodies are layered and positioned between said strip conductor and said ground plane; and a voltage applying circuit connected to at least one of said plurality of ferroelectric bodies, wherein said voltage applying circuit applies a voltage to said at least one of said plurality of ferroelectric bodies to control a frequency of a stop band of said transmission line filter so that the voltage is applied in a direction in which said ground plane and said dielectric composite layer are layered.

2. The transmission line filter according to claim 1, wherein said ground plane has at least one hole reaching said at least one of said plurality of ferroelectric bodies, and wherein said voltage applying circuit is connected with said at least one of said plurality of ferroelectric bodies so that the voltage is applied in a direction in which said ground plane and said dielectric composite layer are layered, and wherein a connection of said voltage applying circuit to a face opposed to said ground plane of said at least one of said plurality of ferroelectric bodies is achieved through said at least one hole of said ground plane.

3. The transmission line filter according to claim 1, further comprising a second dielectric body having a lower dielectric constant than that of said plurality of ferroelectric bodies, wherein said strip conductor is divided into a plurality of segments of the same shape, and wherein said plurality of segments of said strip conductor and said plurality of ferroelectric bodies are alternately arranged in one direction and arranged in close contact with a surface of said second dielectric body.

4. The transmission line filter according to claim 1, wherein said plurality of ferroelectric bodies are formed of a material selected from barium titanate, lead zirconate titanate, and lead zironate titanate doped with lanthanum.

5. The transmission line filter according to claim 1, wherein said ferroelectric bodies are formed with barium titanate, and wherein said paraelectric bodies are formed with alumina.

6. A transmission line filter comprising:

a plurality of ferroelectric bodies of the same shape arranged periodically in a periodical arrangement direction;

a strip conductor connecting said plurality of ferroelectric bodies in said periodical arrangement direction;

a plurality of paraelectric bodies having a dielectric constant lower than that of said plurality of ferroelectric bodies;

a ground plane;

a second dielectric body layered and positioned on said ground plane, wherein said strip conductor is further layered and formed on said second dielectric body, wherein each of said plurality of ferroelectric bodies has a groove engaged with said strip conductor and layered on said strip conductor and said second dielectric body with close contact therewith; and a voltage applying circuit connected to at least one of said plurality of ferroelectric bodies, wherein said voltage applying circuit applies a voltage to said at least one of said plurality of ferroelectric bodies to control a frequency of a stop band of said transmission line filter, and wherein said voltage applying circuit is connected with said at least one of said plurality of ferroelectric bodies so that the voltage is applied in a direction perpendicular to both of a direction in which said ground plane and said second dielectric body is layered and a length direction of said strip conductor.

7. The transmission line filter according to claim 6, wherein said plurality of ferroelectric bodies are formed of a material selected from barium titanate, lead zirconate titanate, and lead zironate titanate doped with lanthanum.

8. A transmission line filter comprising:

a plurality of ferroelectric bodies of the same shape arranged periodically in a periodical arrangement direction;

a strip conductor connecting said plurality of ferroelectric bodies in said periodical arrangement direction;

a plurality of paraelectric bodies having a dielectric constant lower than that of said plurality of ferroelectric bodies; and a ground plane, wherein each of said plurality of ferroelectric bodies has a hole which said strip conductor passes through to be engaged therewith, wherein said strip conductor is connected with said plurality of ferroelectric bodies, passing through said hole of each of said plurality of ferroelectric bodies, and wherein said plurality of ferroelectric bodies, which are integrated with said strip conductor passing therethrough, are each positioned on said ground plane with close contact therewith.

9. The transmission line filter according to claim 8, further comprising a voltage applying circuit connected to at least one of said plurality of ferroelectric bodies, wherein said voltage applying circuit applies a voltage to at least one of said plurality of ferroelectric bodies to control a frequency of a stop band of said transmission line filter, and wherein said voltage applying circuit is connected to said ground plane and said at least one of said plurality of ferroelectric bodies so that the voltage is applied in a direction in which said ground plane and said plurality of ferroelectric bodies are layered.

10. The transmission line filter according to claim 8, wherein said plurality of ferroelectric bodies are formed of a material selected from, lead zirconate titanate, and lead zironate titanate doped with lanthanum.

11. A transmission line filter comprising:

a plurality of ferroelectric bodies of the same shape arranged periodically in a periodical arrangement direction;

a strip conductor connecting said plurality of ferroelectric bodies in said periodical arrangement direction;

a plurality of paraelectric bodies having a dielectric constant lower than that of said plurality of ferroelectric bodies; and a second dielectric body having a lower dielectric constant than that of said plurality of ferroelectric bodies, wherein said strip conductor is divided into a plurality of segments of the same shape, wherein said plurality of segments of said strip conductor and said plurality of ferroelectric bodies are alternately arranged in one direction and arranged in close contact with a surface of said second dielectric body, wherein the transmission line filter further comprises a voltage applying circuit connected to at least one of said plurality of ferroelectric bodies, wherein said voltage applying circuit applies a voltage to at least one of said plurality of ferroelectric bodies to control a frequency of a stop band of said transmission line filter, and wherein said voltage applying circuit is connected with said at least one of said plurality of ferroelectric bodies so that the voltage is applied in a direction perpendicular to both of a direction in which said ground plane and the composite of said plurality of ferroelectric bodies and said strip conductor are layered in a length direction of said strip conductor.

12. The transmission line filter according to claim 11, wherein said plurality of ferroelectric bodies are formed of a material selected from barium titanate, lead zirconate titanate, and lead zironate titanate doped with lanthanum.

13. A control method of a transmission line filter, comprising:

inputting an arbitrary transmission wave into a transmission line filter including a plurality of ferroelectric bodies arranged in a length direction of said transmission line filter;

causing Bragg reflection on said transmission wave by using said plurality of ferroelectric bodies;

changing a frequency of a stop band caused by said Bragg reflection by applying a predetermined voltage to at least one of said plurality of ferroelectric bodies in a direction perpendicular to a length direction of said transmission line filter; and controlling the frequency of said stop band by controlling said applied voltage.

14. The control method according to claim 13, wherein said transmission line filter further includes a plurality of paraelectric bodies, and wherein said plurality of ferroelectric bodies and said plurality of paraelectric bodies are alternately arranged in said length direction of said transmission line filter.

15. The control method according to claim 14, wherein said ferroelectric bodies are formed with barium titanate, and wherein said paraelectric bodies are formed with alumina.

* * * * *